US005335866A

United States Patent [19]

Narao

[11] Patent Number: 5,335,866

[45] Date of Patent: Aug. 9, 1994

[54] WASTE DISPOSER

[75] Inventor: Shinya Narao, Tottori, Japan

[73] Assignee: Kabushiki Kaisha Nissei Giken, Tottori, Japan

[21] Appl. No.: 82,045

[22] Filed: Jun. 24, 1993

[51] Int. Cl.[5] ..... B02C 23/36

[52] U.S. Cl. ..... 241/46.013; 241/46.017; 241/100; 241/101.2; 210/174; 210/415; 100/117

[58] Field of Search ..... 241/46.01, 46.013–46.02, 241/46.017, 100, 101.2; 210/173, 174, 415; 100/93 S, 94, 117

[56] References Cited

U.S. PATENT DOCUMENTS

| | | | |
|---|---|---|---|
| 1,686,095 | 10/1928 | Manning | 210/415 X |
| 3,092,017 | 6/1963 | French et al. | 100/117 X |
| 3,188,942 | 6/1965 | Wandel | 100/117 X |
| 3,527,158 | 9/1970 | Young | 100/117 |
| 4,024,168 | 5/1977 | Homann et al. | 100/93 S |
| 4,337,901 | 7/1982 | Ogura | 241/100 X |
| 5,129,590 | 7/1992 | Shunya | 241/46.013 |

FOREIGN PATENT DOCUMENTS

| | | | |
|---|---|---|---|
| 793823 | 9/1968 | Canada | 210/174 |
| 3258656 | 10/1988 | Japan | 210/173 |
| 939127 | 10/1963 | United Kingdom | 210/174 |

*Primary Examiner*—Mark Rosenbaum
*Assistant Examiner*—Frances Han
*Attorney, Agent, or Firm*—Wolf, Greenfield & Sacks

[57] ABSTRACT

A waste disposer comprises a shredder section for shredding waste material and a water remover section coupled integrally with the shredder section for removing water from the waste material, in which the waste material is shredded with the shredder section and the shredded waste material is carried upward throughout a cylindrical screen member mounted in the water remover section by the rotation of a screw provided in the screen member while its containing water being removed and drained through apertures of the screen member before discharged from the upper end of the screen member. In particular, a projecting reflector of an inverted truncated cone ring-like shape having a downwardly tapered slope arranged on the outer side thereof is mounted to the upper end of the screw for narrowing the upper opening of the screen member.

1 Claim, 4 Drawing Sheets

WASTE DISPOSER

TECHNICAL FIELD

The present invention relates to a waste disposer for grinding and removing raw waste material created in a kitchen.

BACKGROUND ART

Waste disposers are commonly used for grinding and removing raw waste material produced in kitchens, each comprising a shredder for shredding the waste material and a water remover for removing water from the shredded waste material which both are assembled in a unit.

More specifically, such a traditional waster disposer comprises a shredder section communicating to a drain outlet of a kitchen sink and a water remover section for removing water from the shredded waste material. In action, raw material is fed into the shredder section of the disposer where it is shredded with a supply of water and the shredded waste material is transferred into a cylindrical screen member of the water remover section where it is carried upward by means of rotation of a screw blade while its containing water being removed through apertures of the screen member. After the removal of water, the shredded waste material with a minimum of water is disposed from the uppermost of the screen member to drain.

However, the traditional waste disposer has a gap between the upper end of the screw blade and the inner wall of the cylindrical screen member. This causes water fed by rotation of a motor to the shredder section and moved into the screen member of the water remover section to overflow from the uppermost of the screen member through the gap. Accordingly, the overflow of waste water will contaminate peripheral regions of the disposer and produce odor.

DISCLOSURE OF THE INVENTION

It is an object of the present invention to eliminate the foregoing disadvantage.

More particularly, the object of the present invention is to provide an improved waste disposer in which a projecting reflector of an inverted truncated code ring-like shape having a downwardly tapered slope arranged on the outer side thereof is provided on the uppermost of a screw which carries shredded waste material upwards throughout a screen member for removing water in a water remover section so that the shredded waste material is blocked and squeezed by the projecting reflector to close or narrow the upper opening of the screen member during its upward movement. Accordingly, a flow of water transferred from a shredder section to the water remover section is halted by the shredded waste material aggregated at the upper end of the screen member thus staying inside and hardly overflowing from the uppermost of the screen member. Hence, contamination with overflown waste water and its resultant generation of odor will be eliminated.

In more detail, the waste disposer according to the present invention comprises a shredder section communicated with a drain hole of a sink in a kitchen for shredding waste material and a water remover section coupled integrally with the shredder section for removing water from the waste material, in which the waste material is fed together with a supply of water into and shredded with the shredder section, and the shredded waste material is carried upward throughout a cylindrical screen member mounted in the water remover section by the rotation of a screw provided in the screen member while its containing water being removed and drained through apertures of the screen member before discharged from the upper end of the screen member-,and is characterized in that a projecting reflector of an inverted truncated cone ring-like shape having a downwardly tapered slope arranged on the outer side thereof is mounted to the upper end of the screw for narrowing the upper opening of the screen member.

In action, the shredded waste material transferred into the screen member of the water remover section is carried upwards throughout the screen member by the rotation of the screw while its containing water is removed and drained through the apertures of the screen member. The shredded waste water with a minimum of water is blocked by the projecting reflector and aggregated at the upper end of the screen member where the passage is narrowed between the projecting reflector and the inner wall of the screen member before being discharged from the upper end of the screen member.

If a portion of the water fed along with the waste material by the rotation of a motor into the shredder section enters the screen member of the water remover section and flows up to its uppermost end, it will be halted by the shredded waste material aggregated between the projecting reflector and the inner wall of the screen member thus staying inside and hardly overflowing out from the upper end of the screen member. As the result, contamination with overflown waste water and its resultant generation of odor about the waste disposer will be eliminated.

BEST MODE FOR CARRYING OUT THE INVENTION

A preferred embodiment of the present invention will be described in the form of a waste disposer referring to the accompanying drawings.

Figure 1:
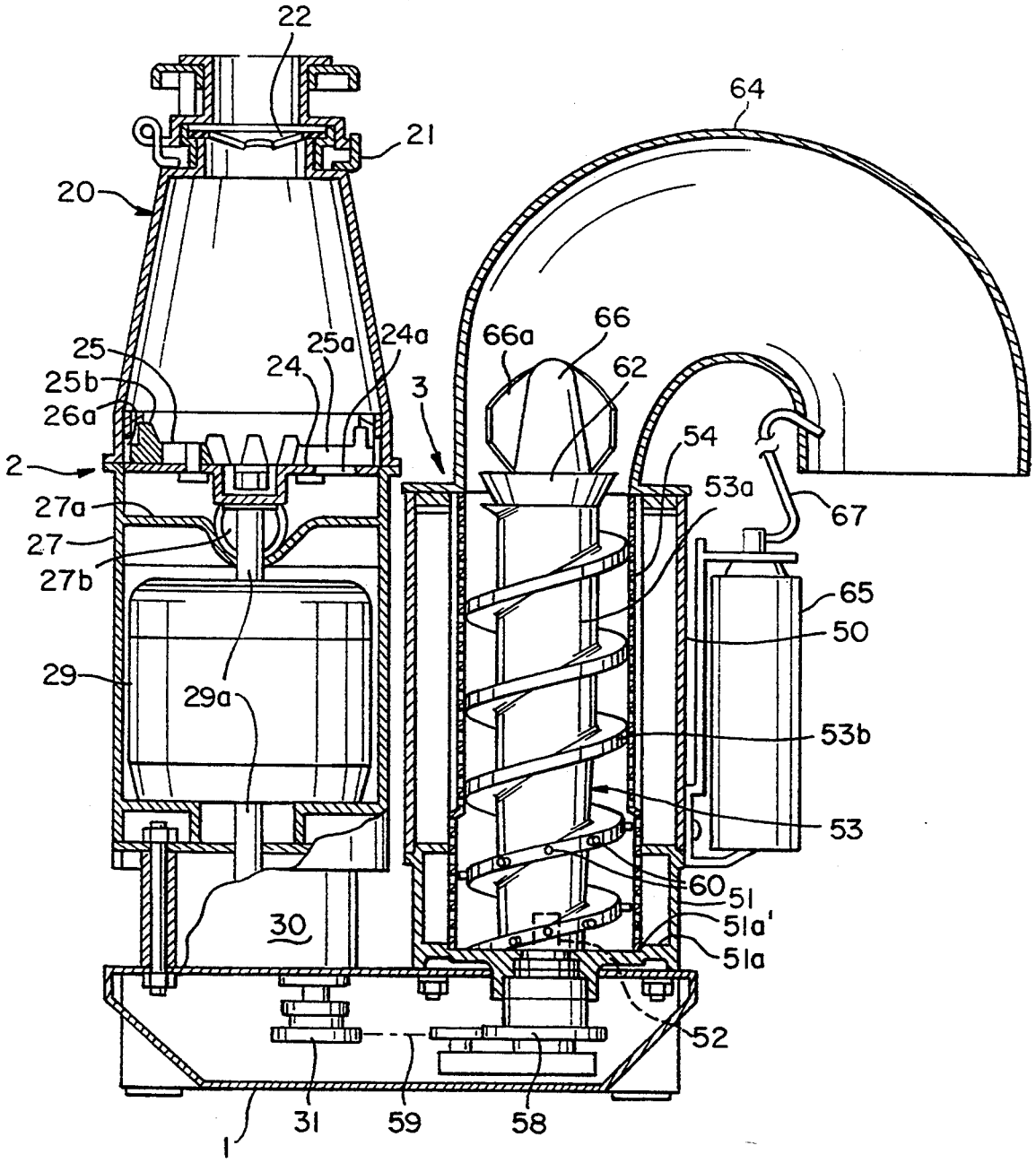
FIG. 1 is a longitudinally cross sectional view of a waste disposer according to the present invention.
Figure 2:
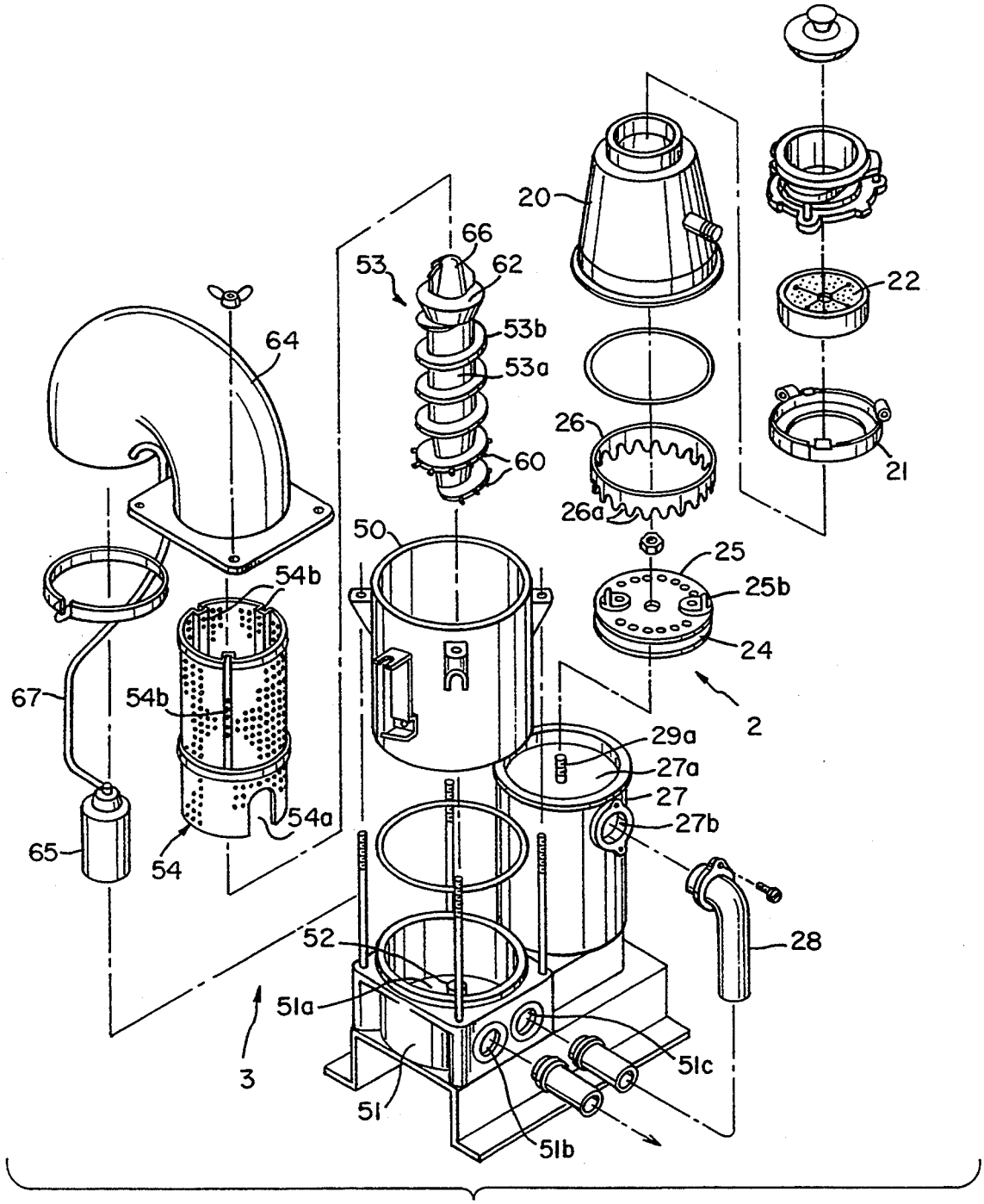
FIG. 2 is an exploded perspective view of the same.
Figure 3:
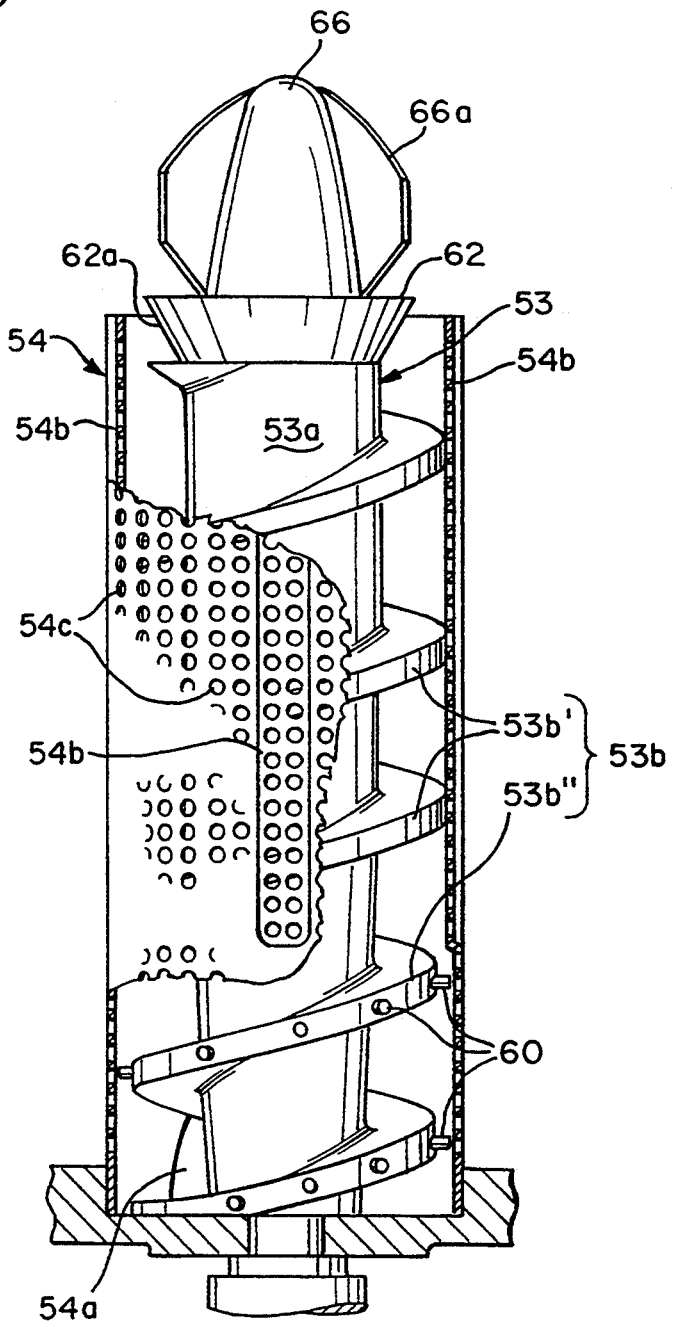
FIG. 3 is a side cross sectional view of a screen member provided with a screw having at uppermost end a projecting reflector.

As shown in FIGS. 1 and 2, the waste disposer according to the present invention comprises a shredder section 2 supported on a base 1 and a water remover section 3 for removing water from raw waste material.

The shredder section 2 includes a waste feeding cylinder 20 provided in the upper thereof and coupled at top to a receiver ring 21. The receiver ring 21 contains a guard member 22 of rubber material which has radially extending slits in the center for preventing escape of waste material and water from the disposer during shredding operation.

The waster feeding cylinder 20 has a shredder ring 26 mounted to the inner wall of a lower opening thereof. The shredder ring 26 has notches **26*a* arranged at lower end thereof and accommodates a pair of shredder members 24 and 25 formed of a substantially oval shape in plan elevation. The shredder members 24 and 25 have numbers of apertures 24a and 25a therein and are fixedly mounted to the drive shaft 29a of a motor 29. The shredder member 25 has a plurality of upwardly projecting shredder blades 25b** mounted on the upper surface edge thereof for shredding the waste material.

The waste feeding cylinder 20 is integrally coupled at lowermost to the upper end of a main cylinder 27 having a bottom plate 27a for receiving the shredded waste material The main cylinder 27 also has an outlet opening 27b provided above its bottom plate 27a for transferring the shredded waste material into the water remover section 3. The outlet opening 27b is communicated to one end of a conduit 28 which extends to an inlet opening 51c of a casing 51 of the water remover section 3 which will be described later.

The main cylinder 20 contains the motor 29 mounted beneath the bottom plate 27a. The drive shaft 29a of the motor 29 upwardly extends through the center of the bottom plate 27a into the interior of the shredder ring 26. The drive shaft 29a having the shredder member 25 threaded onto the uppermost end thereof is coupled at lowermost end to a shift gear case 30 for driving a chain sprocket 31 (or pulley) which extends into the base 1.

The water remover section 3 of the waste disposer includes the casing 51 which has a bottom 51a and is formed of a cylindrical shape. The casing 51 is mounted next to the motor 29 on the base 1 to support a cylindrical housing 50 with the upper end of its wall extending from the bottom 51a.

The casing 51 has a drain outlet 51b provided therein adjacent to the waste material inlet opening 51a for discharging the water removed from the waste material. The bottom 51a of the casing 51 has a drive shaft 52 supported in the center thereof to be driven by the rotation of the motor 29. Also, the bottom 51a of the casing 51 has a stepdown region 51a' in the center to support a cylindrical screen member 54 which extends upward to accommodate a screw 53 described later.

The lowermost end of the drive shaft 52 extends downward through the bottom 51a of the casing 51 and is coupled to a chain sprocket 58 (or pulley) which is linked by a chain 59 (or V-belt) to the chain sprocket 31. The drive shaft 52 is thus driven by the rotation of the shift gear case 30 of the motor 29 and may separately be driven by another motor.

As shown in FIGS. 1 to 4, the screw 53 is integrally formed of a resin material including a body 53a and a spiral blade 53b extending lengthwisely and projecting outwardly of the body 53a. The spiral blade 53b includes an upper region 53b' having a diameter almost equal to the inner diameter of the screen member 54 and a lower region 53b'' having a plurality of metal pins 60 arranged at equal intervals on the outer edge surface of the lower region 53b'' for scraping off waste material from the inner wall of the screen member 54.

The screen member 54 has a multiplicity of apertures 54c provided in the entire wall thereof for discharging the water removed from the waste material. The lowermost end of the screen member 54 is provided with an opening 54a therein for feeding the waste material from the shredder section 2. Also, the screen member 54 has rib portions 54b of about 1 cm in width arranged on the inner wall thereof to project inward and extend from the uppermost end to a central region of the screen member 54 so that the upper region 53b' of the spiral blade 53b can travel directly on the rib portions 54b while the lower region 53b'' travels with its pins 60 directly running on a lower region of the inner wall of the screen member 54 where the rib portions 54b are not provided.

Figure 4:
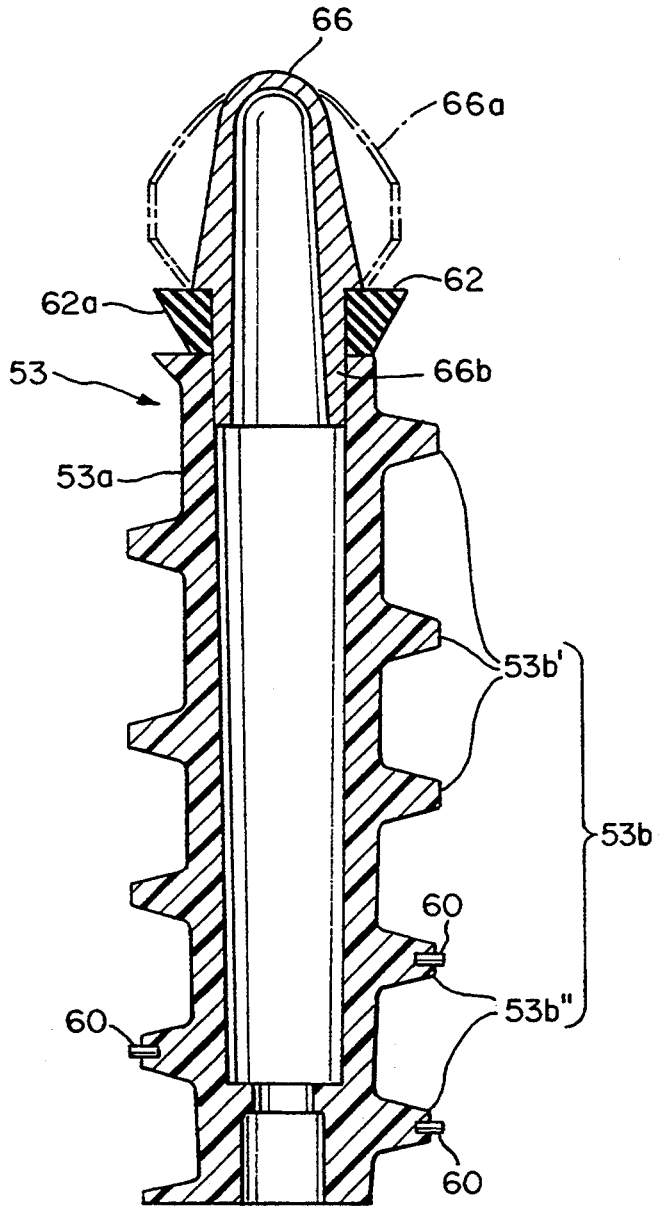
FIG. 4 is a side cross sectional view of the screw having at uppermost end the projecting reflector.

As best shown in FIG. 4, a screw cap 66 is threaded with its stud portion 66b into the upper opening of the screw 53. The screw cap 66 has agitator blades 66a arranged on the side wall thereof for agitating the shredded waste material.

In particular, an annular projecting reflector 62 is fixedly fitted onto the stud portion 66b of the screw cap 66 for guiding and squeezing the shredded waste material. The projecting reflector 62 is formed into an inverted truncated cone with a through opening in the center which has a slope 62a on the outer side thereof tapering towards the lowermost. The uppermost of the projection reflector 62 extends outwardly slightly from the upper opening of the screen member 54 so that the distance between the projection reflector 62 and the inner wall of the screen member 54 is smaller in the upper than in the lower.

As shown in FIG. 1, the upper end of the screen member 54 is coupled to a waste discharging conduit 64 which is identical in the diameter to the screen member 54 and has an arcuate shape sloping from upper to lower. Preferably, a deodorant container 65 is mounted on the side of the housing 50 and has its top outlet coupled to a vinyl tube 67 which extends to an exit portion of the discharging conduit 64.

The process of shredding and disposing raw waste material in the waste disposer will now be explained in a sequence of steps. The waste material from a kitchen is fed together with a flow of water through a drain hole of a sink into the shredder ring 26 of the shredder section 2 as the motor 29 rotates. The waste material in the shredder ring 26 is shredded by the action of the shredder members 24 and 25 driven by the motor 29. The shredded waste material is then transferred from the outlet opening 27b of the main cylinder 27 through the transfer conduit 28 and the casing 51 into the screen member 54 of the water remover section 3. Most water carried with the shredded waste material is discharged from the drain outlet 51b of the casing 51 to an outside drainage system.

The shredded waste material is carried upward throughout the screen member 54 efficiently by the rotation of the screw 53 while being prevented its rotating movement with and aggregated on the rib portions 54b of the screen member 54.

As being carried, the shredded waste material is pressed by the body 53a of the screw 53 against the inner wall of the screen member 54 causing its containing water to remove and flow through the apertures 54c of the screen member 54 into the casing 51 before discharging from the drain outlet 51b of the casing 51 to outside.

The shredded waste material with a less amount of water is blocked and then squeezed by the slope 62a of the projecting reflector 62 mounted at the uppermost of the screen member 54 so as to ascend tightly between the projecting reflector 62 and the inner wall of the screen member 54. After removing from the screen member 54, the shredded waste material is agitated with the agitator blades 66a of the screw cap 66 and then transferred through the waste discharging conduit 64 into an outside waste container (not shown).

Even if a portion of the water fed along with the waste material by the rotation of the motor 29 into the shredder section 2 enters the screen member 54 and flows up to its uppermost end, it will be halted by the shredded waste material aggregated between the projecting reflector 62 and the inner wall of the screen member 54 thus staying inside and hardly overflowing out from the screen member 54.

As set forth above, the projecting reflector of an inverted truncated cone ring-like shape having a downwardly tapered slope is mounted to the upper end of the screw which carries shredded waste material upwards throughout the screen member so that the shredded waste material is squeezed between the projecting reflector and the inner wall of the screen member. Accordingly, the shredded waste material remains for a moment at the upper end of the screen member thus closing or narrowing the upper opening of the same.

This prevents a portion of the water fed along with the waste material into the shredded section and entered into the screen member of the water remover section from over-flowing out from the upper end of the screen member. Hence, unwanted contamination with overflown waste water and its resultant generation of odor about the waste disposer will be eliminated.

I claim:

1. A waste disposer comprising:

a shredder section communicated with a drain hole of a sink in a kitchen for shredding waste material;

a water remover section coupled integrally with the shredder for removing water from the waste material, in which the waste material is fed together with a supply of water into and shredded with the shredder section, and the shredded waste material is carried upward throughout a cylindrical screen member mounted in the water remover section by the rotation of a screw provided in the screen member while its containing water being removed and drained through apertures of the screen member before discharged from the upper end of the screen member;

said screw of the water remover section having a projecting reflector of an inverted truncated cone ring-like shape mounted to the upper end thereof; and said projecting reflector having a downwardly tapered slope arranged on the outer side thereof for narrowing the upper opening of the screen member.

* * * * *